US007424256B2

(12) United States Patent
Natori et al.

(10) Patent No.: US 7,424,256 B2
(45) Date of Patent: Sep. 9, 2008

(54) INTERMEDIATE TRANSFER BELT AND IMAGE FORMING APPARATUS AND IMAGE FORMING METHOD USING THE SAME

(75) Inventors: Yuuji Natori, Numazu (JP); Minoru Matsuo, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 253 days.

(21) Appl. No.: 11/114,026

(22) Filed: Apr. 26, 2005

(65) Prior Publication Data

US 2005/0249529 A1 Nov. 10, 2005

(30) Foreign Application Priority Data

Apr. 26, 2004 (JP) ..... 2004-130354
Apr. 14, 2005 (JP) ..... 2005-117179

(51) Int. Cl.
*G03G 15/01* (2006.01)

(52) U.S. Cl. ..... 399/302

(58) Field of Classification Search ..... 399/162, 399/302, 303, 308, 312, 313, 329; 430/125.32
See application file for complete search history.

(56) References Cited

U.S. PATENT DOCUMENTS 5,308,569 A * 5/1994 Hamamoto et al. ..... 264/216
5,922,440 A * 7/1999 Schlueter et al. ..... 428/195.1
6,044,243 A * 3/2000 Hara ..... 399/302
6,066,400 A * 5/2000 Law et al. ..... 428/412
6,143,399 A * 11/2000 Kohno et al. ..... 428/220
6,217,996 B1 * 4/2001 Yamamoto et al. ..... 428/220
6,406,741 B1 * 6/2002 Law ..... 427/58
2003/0090031 A1 * 5/2003 Nojiri et al. ..... 264/234

FOREIGN PATENT DOCUMENTS

JP 11-109761 4/1999
JP 2001097519 A * 4/2001
JP 2002-244391 8/2002
JP 2003-145561 5/2003
JP 2004012669 A * 1/2004

OTHER PUBLICATIONS

U.S. Appl. No. 10/963,561, filed Oct. 14, 2004, Natori et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

An intermediate transfer belt and an image forming apparatus including the belt may include a drawn component not greater than 98% of which is imidized. The intermediate transfer belt may be used in an electrophotographic image forming process in which a toner image of each color formed on plurality of image bearing members is overlappingly transferred to the intermediate transfer belt to form a multi-colored image thereon. The multi-colored image is transferred to a transfer material.

17 Claims, 8 Drawing Sheets

INTERMEDIATE TRANSFER BELT AND IMAGE FORMING APPARATUS AND IMAGE FORMING METHOD USING THE SAME

BACKGROUND OF THE INVENTION

1. Field of the Invention

The present invention relates to an endless intermediate transfer belt to which multiple toner images formed of a single color on multiple image forming members are overlappingly transferred. The toner images form a multi-colored image which is transferred to a transfer material. An image forming apparatus including the intermediate transfer belt, an image forming method using the intermediate transfer belt and a method of manufacturing the intermediate transfer belt are also described.

2. Description of the Background

To obtain multi-colored images by using an image forming apparatus such as a photocopier and a printer, the following processes are typically used:

(1) Forming images of a single color on image bearing members;

(2) Sequentially overlappingly transferring each color image to an intermediate transfer belt serving as intermediate transfer medium; and (3) Electrostatically transferring the image on the intermediate transfer belt to a transfer material simultaneously.

The image forming apparatus mentioned above has been improved with regard to the speed of photocopying and the image quality and is now expected to have the same image quality as that of printing machines with regard to multiple-color overlapped images.

Published unexamined Japanese Patent Application No. (hereinafter referred to as JOP) 2002-244391 discloses an image forming apparatus which can prevent registration shift during intermediate transfer by controlling the rotation speed of multiple image bearing members and the surface speed of an image transfer belt to form images with good quality without color shift.

In addition, JOP11-109761 discloses an intermediate transfer belt for use informing electrophotographic images which is flow-cast to form an endless belt by centrifugal-molding single-layer structured materials formed of thermosetting resins having a high temperature resistivity such as polyimides, polyamideimides and electroconductive carbon which is dispersed in the resin.

Further, JOP 2003-145561 discloses a technology by which aromatic polyimides having an inflexible structure are highly drawn to orient molecules.

However, the inventions mentioned above have the following drawbacks.

It is practically impossible to eliminate the difference between the rotation speed of multiple image bearing members and the surface speed of an intermediate transfer belt, even after these speeds are controlled. Registration shifts of color images on an intermediate transfer belt thus tend to occur, especially when the belt has a low elasticity modulus. As a result, good image quality is not obtained.

In recent years, more and more photocopiers and printers include a four-tandem engine system (significantly increasing speed), in which a color image is formed in one pass, instead of a single engine system (printing speed is slow), in which a transfer drum must rotate four times to form one color image.

However, since a four color toner image is formed on an intermediate transfer belt in one pass, there is a color shift in the image finally obtained because of slackening between the right hand side portion and the left hand side portion of the intermediate transfer belt, and flexure of the belt between each transfer drum. These problems are caused by transient decrease in the speed of the intermediate transfer belt due to the contact between the intermediate transfer belt and transfer drums for each color.

In addition, in JOP 2003-145561, the technology disclosed therein is not applied to an intermediate transfer belt using a polyimide resin to which an electroconductive agent such as carbon black is added. When this disclosed technology is applied to such an intermediate transfer belt, since a filler represented by black carbon, etc., is mixed in the polyimide film as an electroconductive agent and imparts semi-conductive properties. Thus charged toner particles can be transferred from a transfer drum to an intermediate transfer belt because of this filler. This is true for the case of transfer to a printing paper.

SUMMARY OF THE INVENTION

The present inventors recognized a need exists for an endless intermediate transfer belt for use in forming electrophotographic images which can prevent slackening of the intermediate transfer belt and a registration shift of color images formed thereon, an image forming apparatus having the intermediate transfer belt, and an image forming method using the intermediate transfer belt.

Accordingly, an object of the present invention is to provide an endless intermediate transfer belt for use in forming electrophotographic color images which can prevent slackening of the intermediate transfer belt and a registration shift of images formed thereon to improve the quality of color images formed by using a tandem engine system. In addition, the present invention has another object of providing an image forming apparatus having the intermediate transfer belt mentioned above and an image forming method using the intermediate transfer belt mentioned above.

Briefly these objects and other objects of the present invention as hereinafter will become more readily apparent and can be attained by an intermediate transfer belt including a drawn component not greater than 98% of which is imidized. The intermediate transfer belt is used in an electrophotographic image forming process in which a toner image of each color formed on plurality of image bearing members is overlappingly transferred to the intermediate transfer belt to form a multi-colored image thereon and then the multi-colored image is transferred to a transfer material.

As another aspect of the present invention, an intermediate transfer belt is provided which is prepared by a process including the steps of transferring a mixture of a solution of a thermosetting resin and a particulate electroconductive material into a centrifugal mold, rotating the centrifugal mold to form a film attached to an inner periphery thereof, thermally imidizing the film to have an imidization ratio not greater than 98%; and drawing the film to entirely harden the film and to form the intermediate transfer belt. The intermediate transfer belt is used in an electrophotographic image forming process in which a toner image of each color formed on plurality of image bearing members is overlappingly transferred to the intermediate transfer belt to form a multi-colored image thereon, which is transferred to a transfer material.

It is preferred that the drawing is performed in the circumferential direction of the film.

It is still further preferred that the drawing is performed in the circumferential direction of the film to a drawing magnification power of 1.01 to 1.10.

It is still further preferred that the film is drawn by a drawing base at a constant drawing speed in the circumferential direction thereof while the film is rotated.

It is still further preferred that the drawing is performed in the axial direction of the film.

It is still further preferred that the drawing is performed in the axial direction of the film to a drawing magnification power of 1.01 to 1.20.

It is still further preferred that the drawing is performed in the circumferential direction and the axial direction of the film.

It is still further preferred that the drawing is performed in the circumferential direction and the axial direction of the film to a drawing magnification power of from 1.01 to 1.15.

It is still further preferred that, while the film is rotated, the film is drawn by a chucking portion of a drawing device in a direction different from the rotation direction of the film.

It is still further preferred that the mixture for forming the endless intermediate transfer belt is a polyamic acid solution.

It is still further preferred that the thermal imidizing is performed at a temperature range of from 25 to 220° C.

It is still further preferred that the drawing is performed in a temperature range of from 25 to 220° C.

It is still further preferred that the intermediate transfer belt has an elasticity modulus of from 7,000 to 15,000 MPa.

It is still further preferred that the intermediate transfer belt has a surface resistivity ρs of from $1.0\times10^{10}$ to $1.0\times10^{13}\Omega$.

It is still further preferred that the intermediate transfer belt has a volume resistivity ρv of from $1.0\times10^{5}$ to $1.0\times10^{11}$ Ωcm.

As another aspect of the present invention, an image forming apparatus is provided which includes the following: an image bearing member configured to bear a latent electrostatic image; a charging device configured to charge a surface of the image bearing member; a developing device configured to develop the latent electrostatic image with a toner; a cleaning device configured to remove residual toner on the image bearing member; an intermediate transfer belt configured to transfer the toner image on the image bearing member to form an image thereon and to transfer the toner image onto a recording material, the intermediate transfer belt, a fixing device configured to fix the toner image on the recording material. The intermediate transfer belt is prepared by the following: transferring a mixture of a solution of a thermosetting resin and a particulate electroconductive material into a centrifugal mold; rotating the centrifugal mold to form a film attached to an inner periphery thereof; thermally imidizing the film to have an imidization ratio not greater than 98%; and drawing the film to entirely harden the film and to form the intermediate transfer belt.

As another aspect of the present invention, an image forming method is provided which includes the following steps; irradiating an image bearing member with a laser beam to form a latent electrostatic image on the image bearing member; developing the latent electrostatic image with a toner; removing residual toner on the image bearing member; first transferring the toner image to an intermediate transfer belt; second transferring the toner image on the intermediate transfer belt to a recording material; and fixing the toner image on the intermediate transfer belt upon application of heat and pressure. The intermediate transfer belt is prepared by the following process: transferring a mixture of a solution of a thermosetting resin and a particulate electroconductive material into a centrifugal mold; rotating the centrifugal mold to form a film attached to an inner periphery thereof; thermally imidizing the film to have an imidization ratio not greater than 98%; and drawing the film to entirely harden the film and to form the intermediate transfer belt.

As another aspect of the present invention, a method of manufacturing an intermediate transfer belt is provided which includes the following steps: transferring a mixture of a solution of a thermosetting resin and a particulate electroconductive material into a centrifugal mold; rotating the centrifugal mold to form a film attached to an inner periphery thereof; thermally imidizing the film to have an imidization ratio not greater than 98%; and drawing the film to entirely harden the film and to form the intermediate transfer belt. The intermediate transfer belt is used in an electrophotographic image forming process in which a toner image of each color formed on plurality of image bearing members is overlappingly transferred to the intermediate transfer belt to form a multi-colored image thereon, which is transferred to a transfer material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
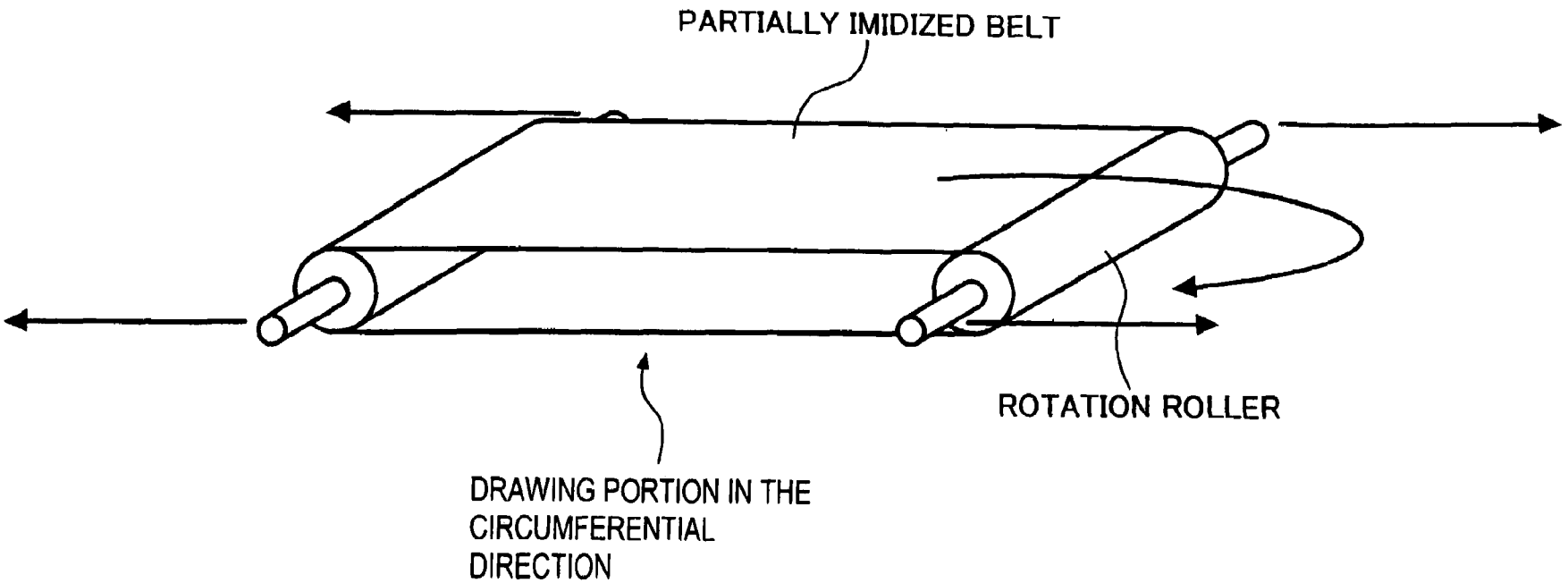
FIG. 1 is a schematic perspective diagram illustrating an example of a method of drawing the endless intermediate transfer belt of the present invention for use in electrophotography in its circumferential direction.

The present invention will be described below in detail with reference to several embodiments and accompanying drawings, wherein like reference numerals designate identical or corresponding parts throughout the several views.

Polymers for use in an intermediate transfer belt for use in electrophotography process performed by a color photocopier are required to have good flame resistance, strength and electric stability. Polyimide resins are excellent materials in terms of strength, thermal resistance and friction chargeability. In embodiments of the present invention, an endless intermediate transfer belt for use in electrophotography may be manufactured using polyimide resins.

Polyimide resins are synthesized from its precursor, i.e., polyamide acids. Polyamide acids have a characteristic in that a polyamide acid change to a polyimide upon application of heat or by a catalyst through imide ring closure and is dissolved in a particular solvent.

In the present invention, various kinds of electroconductive particulate materials or particulate materials having a low electric resistance are used as materials to control the resistance of the intermediate transfer belt. For example, metal powder and metal suboxide powder of tin oxide and indium oxide, and preferably carbon black powder can be used. Also these can be used in combination and nonvolatile liquid having a low electric resistance can be also mixed therewith. In one embodiment, carbon is dispersed in a polyamide acid solution (hereinafter referred to as mixed polyamic acid solution).

Carbon can be typified into acetylene black, oil furnace black, thermal black, channel black, etc. Acetylene black is obtained by thermal decomposition in a furnace where acetylene has been preliminary heated. Oil furnace black can be prepared by blowing oil into a furnace to perform incomplete combustion by controlling the amount of air, and subsequent to cooling down, capturing the carbon with a cyclone, etc. Thermal black can be obtained by alternately heat reserving and heat decomposing natural gas in a regenerative heater in a temperature range of from 200 to 1,700° C. Channel black can be obtained by blowing natural gas flame onto a long strip iron plate and attaching carbon thereto. Materials having a specific gravity close to that of polyamic acid and not much different from that of a resin may be used as electroconductive materials.

There is no specific limitation to the selection of carbons for use in the endless intermediate transfer belt for use in forming electrophotographic images. However, when an intermediate transfer belt having a high surface resistance is desired, carbon providing a high electroconductivity when added in a small amount, such as acetylene black (manufactured by Denki Kagaku Kogyo Kabushiki Kaisha) and ketchen black EC (manufactured by Lion Corporation), may be avoided.

Carbon may be dispersed by supersonic dispersion methods, ballmill dispersion methods, sandmill dispersion methods, etc. Typically, instead of directly dispersing carbon in a polyamide acid solution, carbon is dispersed in N-methyl pyrrolidone (hereinafter referred to as NMP) and the resultant carbon dispersion solution is mixed with a polyamide acid solution. A carbon solution in which carbon having a particular particle diameter is dispersed is thus prepared.

FIG. 5 illustrates a manufacturing method of an endless intermediate transfer belt of the present invention for use informing electrophotographic images. As illustrated in FIGS. 5A and 5B, a predetermined amount of a polyamide acid solution 31, which is a mixture of a polyamide acid solution 29 and a carbon dispersion solution 30, is first poured into a centrifugal mold. The mixture is poured while the centrifugal mold is slowly rotated. When pouring the mixture is complete, the rotation speed of the centrifugal mold is gradually increased to a predetermined rotation speed. The centrifugal mold is rotated at the predetermined speed for a predetermined period of time.

Figure 5A:
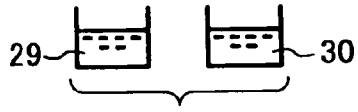
FIGS. 5A to 5F are diagrams illustrating a preparation method of the endless intermediate transfer belt of the present invention for use in electrophotography.
Figure 5B:
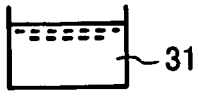
Figure 5C:
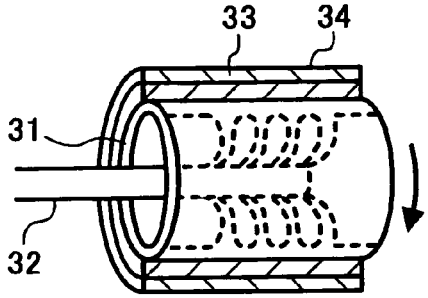

In one embodiment, as illustrated in FIG. 5C, the polyamide acid mixture solution 31 is poured into a cylinder mold 33 serving as a centrifugal mold by way of a pouring tube 32. The cylinder mold 33 has an inner diameter of 100 mm and a length of 250 mm. The cylinder mold is rotated at 10 rpm while the polyamide acid mixture solution 31 is poured until the mixture is completely poured.

Figure 5D:
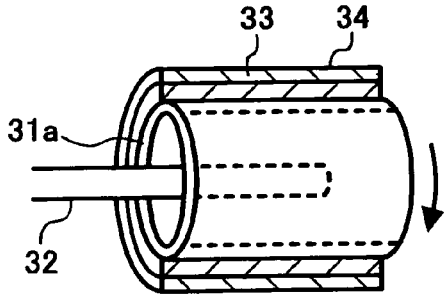

Next, as illustrated in FIG. 5D, when pouring is finished, the rate of rotation of the cylinder mold 33 is increased to 400 rpm. Thereafter, the cylinder mold 33 is gradually heated to 100° C. by a heater having a sheet form 34. The temperature is kept near 100° C. to volatilize the solvent from a polyamide acid mixture solution layer 31*a*, which is applied to the inner circumference of the cylinder mold 33. In one embodiment, the cylinder mold 33 is not heated by a heater having a sheet form 34, and can be heated by a heating furnace, etc.

The organic solvent evaporates while the centrifugal mold is rotated so that the polyamide acid is increasingly solidified, resulting in formation of a film having a cylindrical form.

In one embodiment, two-axis roll drawing is performed in the temperature range of from 25 to 220° C. in which polyamide acid solution is changed to polyimide through imide ring closure (i.e. partially imidization). When this two-axis-roll drawing is performed at too high a temperature, solidification occurs along with partial imidization, which is not suitable for drawing. In contrast, when this two-axis-roll drawing is performed at too low a temperature, the obtained film does not sufficiently support itself so that it is impossible to draw the obtained film.

In one embodiment, the drying temperature range for drawing is from 80 to 170° C. When the temperature is too high, the surface which is partially imidized is not uniform. When the temperature is too low, the film to be drawn does not have enough strength to support itself.

Next, the device and the method for use in drawing are concretely described.

After sufficiently volatilizing the solvent from the polyamide acid mixture solution layer 31*a*, the belt 31*b* finished with primary drying is removed from the cylinder mold 33. The film finished with the primary drying is a partially imidized film (i.e., in a partially solidified state) and also is in a rubber state in which the solvent composition is still contained in a large amount. The film in this rubber state can be subject to swelling treatment using a solvent if necessary.

Next, drawing in the circumferential direction is performed. The belt 31*b* removed from the cylinder mold 33 is set on a drawing device for use in drawing in the circumferential direction. The base of the drawing device is moved in the circumferential direction at a particular drawing speed until the belt is drawn while the belt is rotated.

In one embodiment, the drawing magnification power is from 1.01 to 1.10. When the drawing magnification power is too large, the surface property of the belt deteriorates. When the drawing magnification power is too small, the value of the elasticity modulus is not improved by drawing.

While drawing, the partially imidized belt is rotated at a constant speed by a rotation roller. The drawing device base is moved at a speed as low as possible. The diameter of the rotation roller contained in the drawing device may be as large as or less than the diameter of a roller to which the intermediate transfer belt is installed in an image forming apparatus.

Figure 4:
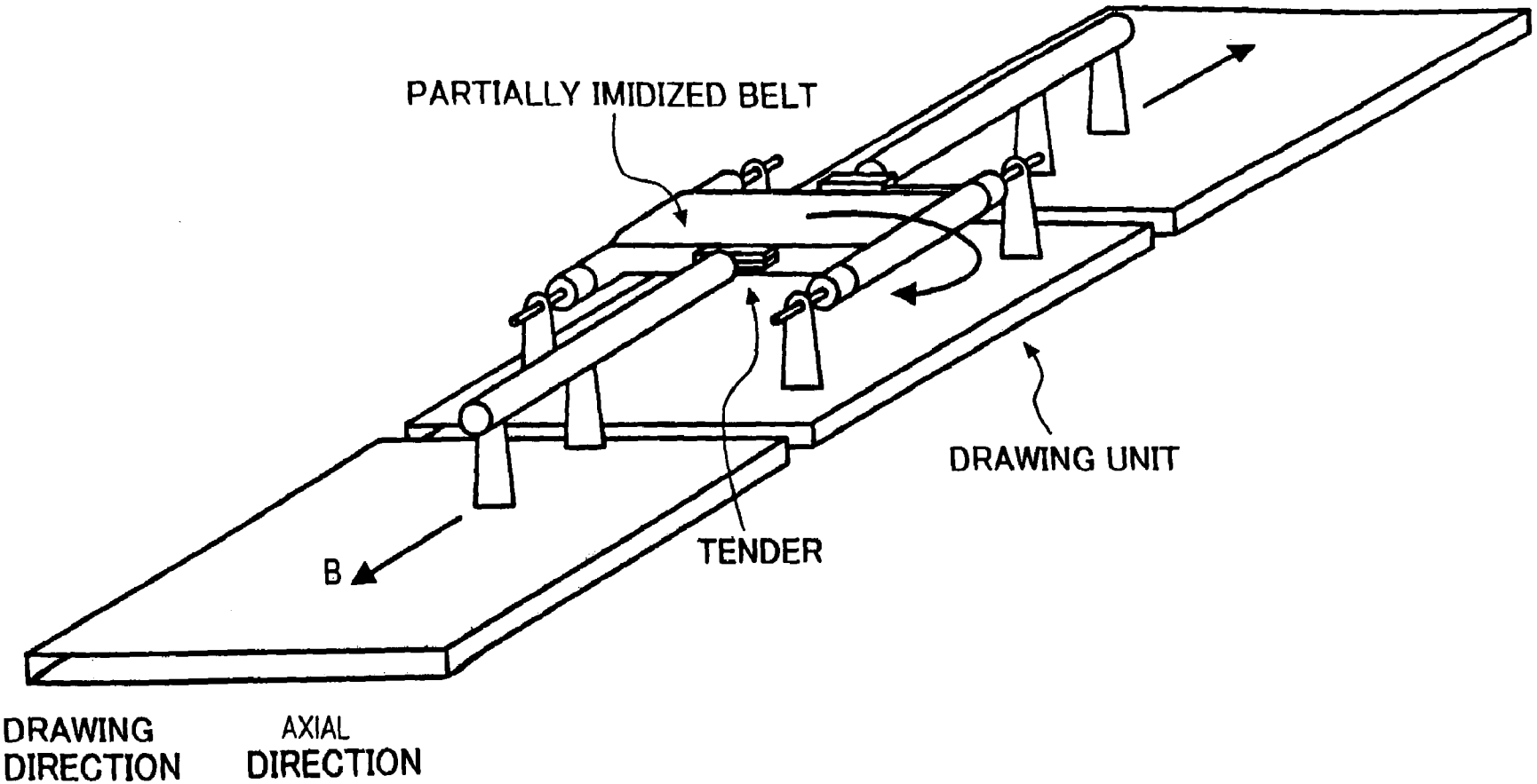
FIG. 4 is a perspective diagram illustrating an example of the drawing device which draws the endless intermediate transfer belt of the present invention for use in electrophotography in its axial direction.

The belt can be drawn to the axial direction. A film which has finished with primary drying and achieved a partially imidized state is set on a device for use in drawing in the axial direction to a drawing magnification of from 1.01 to 1.20 as illustrated in FIG. 4. In addition a partially imidized film which is finished with the circumferential direction drawing can be also set on a device for use in drawing in the axial direction to a drawing magnification of from 1.01 to 1.15.

The partially imidized belt is drawn in the axial direction by a chucking portion remodeled based on a manually-driven drawing device while the partially imidized belt is rotated at a constant speed by a rotation roller.

The method of drawing the belt is not limited to the method mentioned above. The belt can be drawn by other methods such as a tender method and a tube method. The belt can be drawn in a direction different from the circumferential direction by a tender. In one embodiment, the drawing temperature range for drawing is from 25 to 220° C. This drawing temperature can be arbitrarily set depending on conditions.

In one embodiment, the diameter of the rotation roller contained in the drawing device is as large as or less than the diameter of a roller to which the intermediate transfer belt is installed in an image forming apparatus. It is possible to control the thickness of the belt by controlling the outer diameters of the center portion and the end portion of the roller. Thereby, it is possible to prevent deviation of the thicknesses of the center portion and the end portion after drawing.

The physicality of the film can be improved by the drawing treatment mentioned above. The reason why the mechanical strength of the film is improved is that after sufficiently volatilizing the solvent from the polyamide acid mixture solution layer 3l*a* (i.e., after primary drying is finished), the arrangement of polyamic acid molecules is aligned in one direction by drawing, resulting in amelioration of the mechanical strength of the film.

The mechanical strength of a film can be controlled by uniformly aligning the molecular orientation. Namely, the strength of an endless intermediate transfer belt for use in forming electrophotographic images can be controlled by controlling the drawing magnification power and the drawing direction.

Figure 5E:
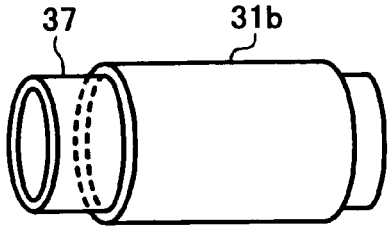
Figure 5F:
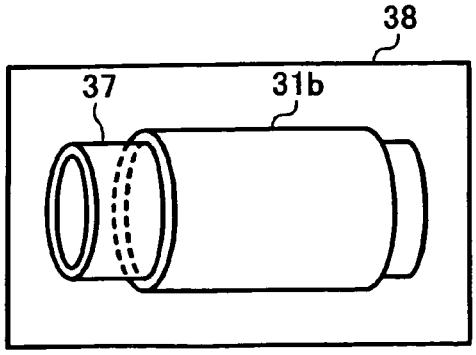

After the drawing treatment mentioned above, the polyamide acid belt 31*b* is set on an imidization mold 37 as illustrated in FIG. 5E. Next, as illustrated in FIG. 5F, the polyamide acid belt 31*b* set on the imidization mold 37 is set in a furnace 38, the temperature of which is maintained to be 300° C. and heated for 20 minutes to obtain a wholly aromatic polyimide belt. The polyamide acid film which has finished with drawing treatment may be further heated for imide ring closure to further improve its characteristics such as thermal resistance, chemical resistance and mechanical strength. This imide ring closure is performed by heating and the solvent remaining in the polyamide acid film is thoroughly evaporated and removed.

The imide ring closure can be performed by heating the film at the temperature mentioned above for the time mentioned above while still rotating the film after the partial imidization treatment and two-axis roll treatment. Also, the imide ring closure can be performed by removing the polyamic acid film from the centrifugal mold, coating the film on a cylindrical imidization mold prepared separately and entirely heating the film and the mold by way of a heating means such as hot air.

The polyimide film thus obtained is suitably processed to a variety of applications. As in the present invention, when the polyimide film is used as an endless intermediate transfer belt for use in the electrophotographic process performed by, for example, a color photocopier, the film is severed to a required length and a member to prevent twisting of the film is set on both open ends thereof if necessary.

In addition, the range of the surface resistivity of the obtained intermediate transfer belt is from $1.0\times10^{10}$ to $1.0\times10^{13}\Omega$. When the surface resistivity is too high, electric charges are present only on the surface of the intermediate transfer belt and do not move inside the intermediate transfer belt so that the electric field is weak. When the surface resistivity is too low, the electric charges tend to flow in the lateral direction. The range of the volume resistivity of the obtained intermediate transfer belt is from $1.0\times10^{5}$ to $1.0\times10^{11}$ Ωcm. When the volume resistivity is too high, electric charges are present only on the surface of the intermediate transfer belt and do not move inside the intermediate transfer belt so that the electric field is weak. When the volume resistivity is too low, the electric charges tend to flow in the lateral direction.

Having generally described embodiments of this invention, further understanding can be obtained by reference to certain specific examples which are provided herein for the purpose of illustration only and are not intended to be limiting.

EXAMPLES

The present invention is further concretely described with reference to examples below. The examples below are with regard to belts formed of a polyimide but belts formed of other resin materials can be also used.

Figure 8:
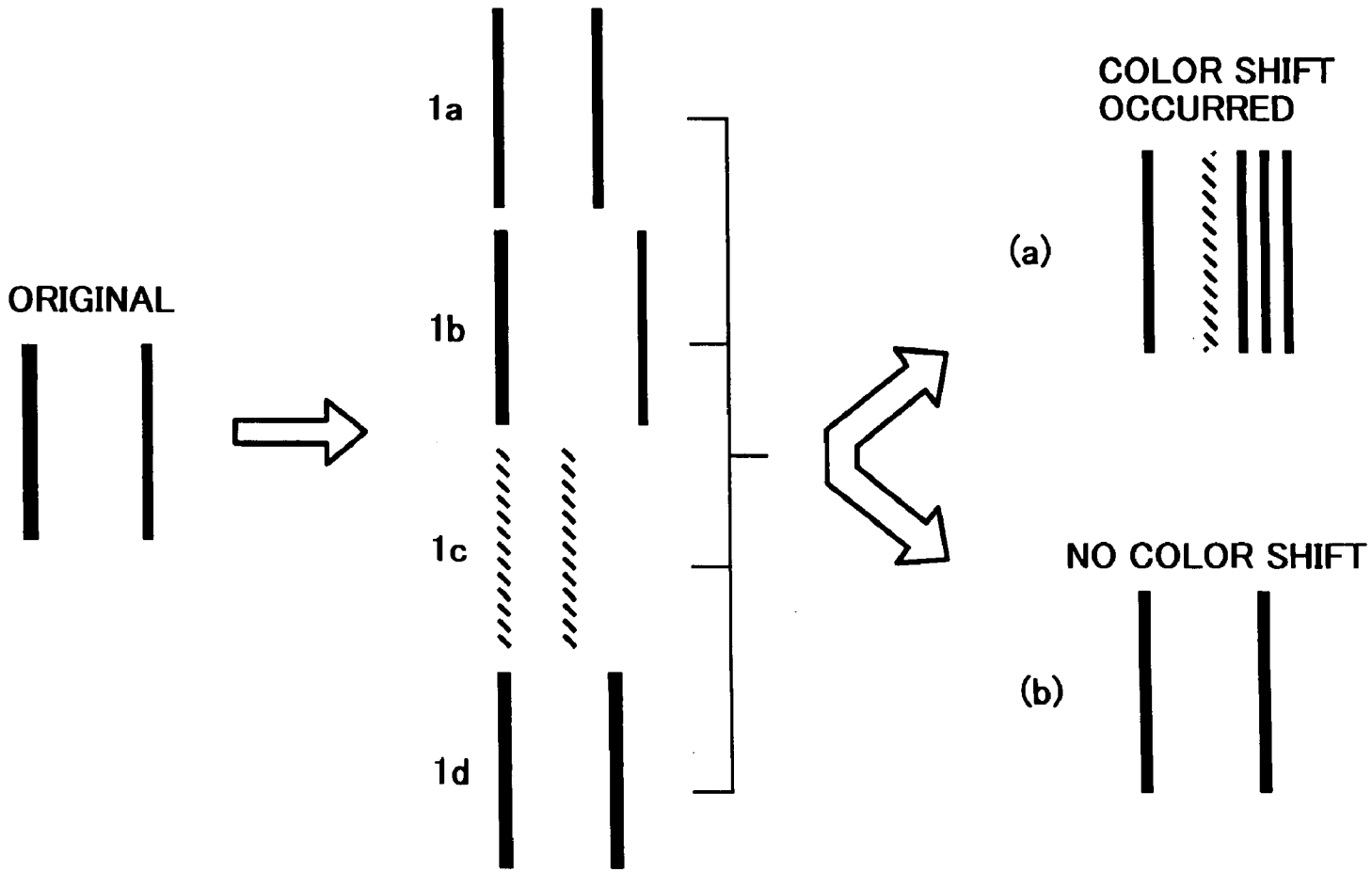
FIG. 8 is a diagram illustrating an example of an image printed by the image forming apparatus using the endless intermediate transfer belt of the present invention for use in electrophotography.

FIG. 8 is a diagram illustrating color shifts of color images. Color shift occurring when two line images are formed is described as an example.

In the case of a two-line image in which four colors are overlapped, unless the distances between the two lines for each color are the same, a color shift occurs in the two-line image.

It is not likely that the distance between the two lines formed on a transfer drum for each color varies since the two lines are written on the transfer device for each color with the same writing device.

When the surface speed of each image forming member 1*a*, 1*b*, 1*c* and 1*d* matches the surface speed of an intermediate transfer belt 10 (shown in FIG. 7) at the transfer portion (i.e., when writing and transferring are synchronized), the images are transferred and overlapped on the intermediate transfer belt 10 from each image bearing member while the distances illustrated in FIG. 8 are maintained as the same, resulting in no occurrence of color shift (shown in FIG. 8(*b*)).

However, when the surface speed of each image forming member 1*a*, 1*b*, 1*c* and 1*d* does not match the surface speed of an intermediate transfer belt 10 at the transfer portion, the line distances on each image bearing member 1*a*, 1*b*, 1*c* and 1*d* vary when the image is transferred onto the intermediate transfer belt 10. Therefore, a color shift occurs as illustrated in FIG. 8(*a*).

Example 1

As illustrated in FIG. 5A, a base material 29 and a solution 30 were prepared. In the base material 29, a polyamide acid was dissolved in NMP such that the amount of the polyamide acid was 20 weight %. In the solution 30, ASAHI #60H (N-658) (furnace black manufactured by Asahi Carbon Co., Ltd.) was dispersed in NMP. Several kinds of solution can be mixed in each of the base material 29 and the solution 30.

Next, as illustrated in FIG. 5B, the base material 29 was mixed with the solution 30 in which ASAHI #60H (N-568) was dispersed (hereinafter this mixture is referred to as a polyamide acid mixture solution 31). The composition was that ASAHI #60 (N-258) was 22 phr (solid portion) based on the solution portion of the polyimide.

Next, as illustrated in FIG. 5C, the polyamide acid mixture solution 31 was poured to the cylinder mold 33 contained in a centrifugal mold through a pouring tube 32. The cylinder mold had an inner diameter of 124 mm and a length of 250 mm. When the polyamide acid mixture solution 31 was poured, the cylinder mold 33 was rotated at 10 rpm and this rotation speed was not changed until the pouring was finished.

When the pouring was finished, the rotation speed of the cylinder mold 33 was increased up to 400 rpm as illustrated in FIG. 5D. Thereafter, while the cylinder mold 33 was gradually heated up to 100° C. by a heater having a sheet form 34 and the temperature was kept near 100° C. to volatilize the solvent of the polyamide acid solution layer 31*a* coated on the inner circumference of the cylinder mold 33.

Figure 2:
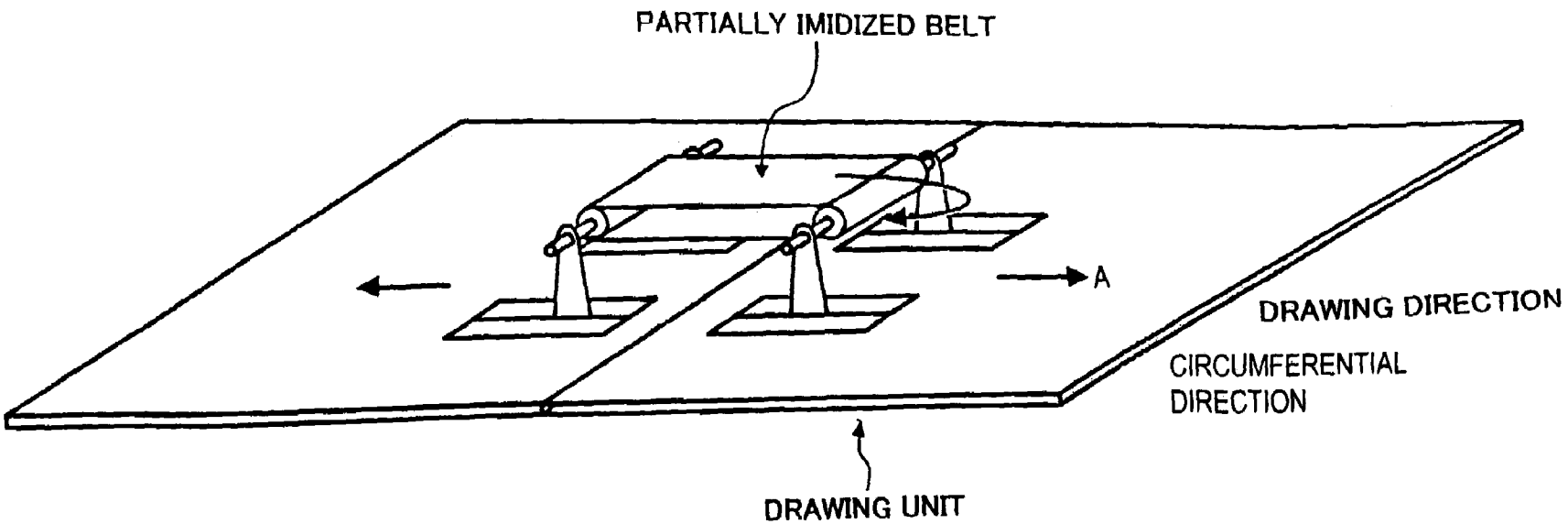
FIG. 2 is a perspective diagram illustrating an example of the drawing device which draws the intermediate transfer belt of the present invention having an endless form for use in electrophotography in its circumferential direction.
Figure 3:
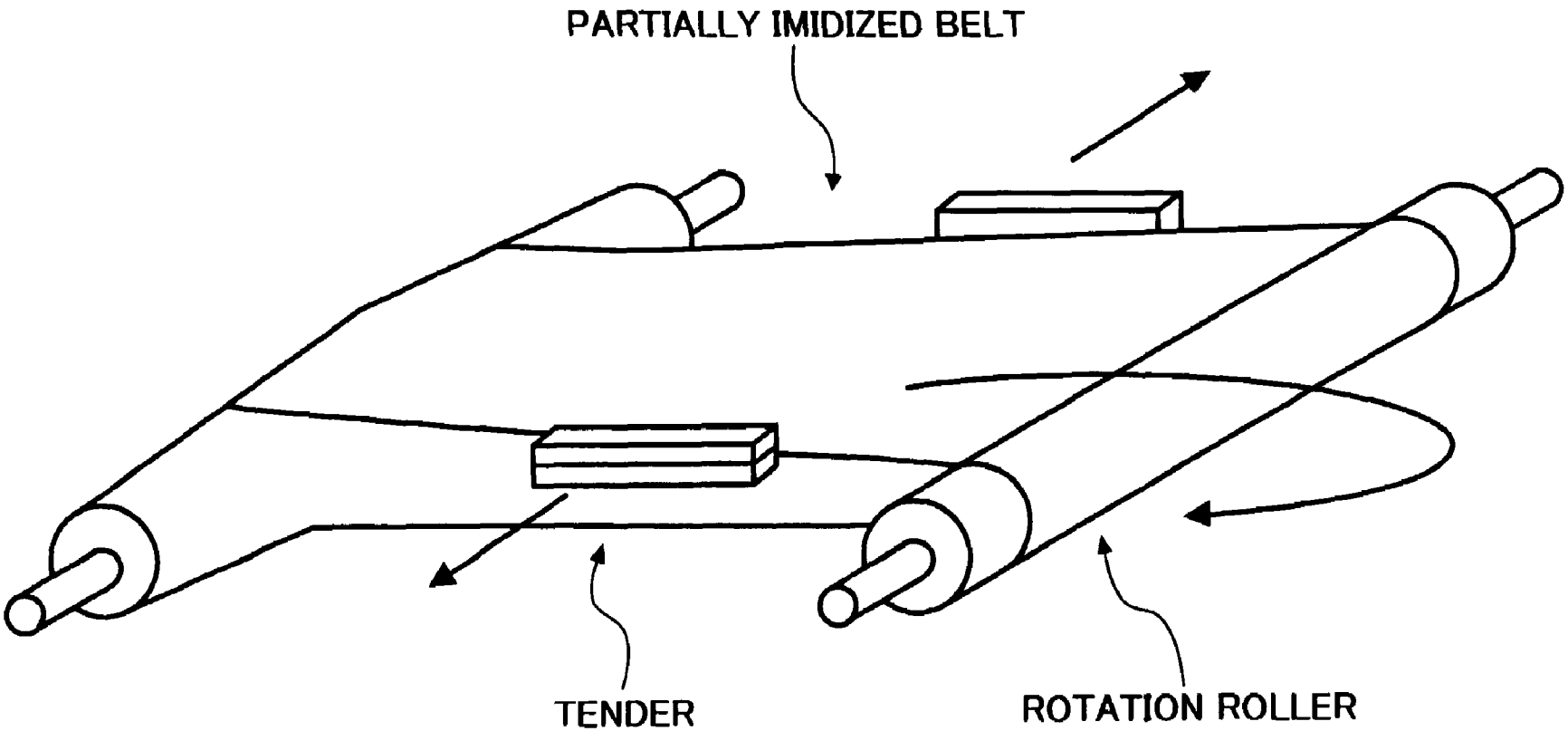
FIG. 3 is a schematic perspective diagram illustrating an example of a method of drawing the endless intermediate transfer belt of the present invention for use in electrophotography in its axial direction.

Next, after sufficiently volatilizing the solvent of the polyamide acid mixture solvent layer 31*a*, a polyamide acid belt (i.e., a partially imidized belt) 31*b* was removed from the cylinder mold 33, set on a drawing device of drawing the belt in the circumferential direction indicated by arrow A in FIG. 2, and heated at 120° C. Thereafter the belt was heated at 220° C.

Then, the base of the drawing device was moved at a constant drawing speed to a predetermined drawing magnification power while the partially-imidized belt was rotated. The predetermined drawing magnification power was 1.05 in this case.

After the polyamide acid belt 31 was drawn in its circumferential direction, the polyamide acid belt 31 was set on a device by which the belt was drawn to its axial direction indicated by arrow B in FIG. 4. The polyamide acid belt 31*b* was drawn to a predetermined drawing magnification power by a chucking portion remodeled based on a manually-driven drawing device while the polyamide acid belt 31*b* was rotated by a rotation roller. In this example, the polyamide acid belt 31*b* was repetitively drawn until the drawing magnification power reached 1.07.

As illustrated in FIG. 5E, the polyamide acid belt 31*b* was set on an imidization mold 37. The imidization mold 37 was then put into a furnace 38 the temperature of which was maintained at 300° C. (as illustrated in FIG. 5F), and heated for 20 minutes to obtain an intermediate transfer belt.

The elasticity modulus of the intermediate transfer belt manufactured by the processes mentioned above was measured based on JIS-K7127 using a Shimadzu AGS-50A measurement device. The measuring result was that the elasticity moduli in the circumferential direction and in the axial direction were 8,100 MPa and 8,200 MPa, respectively.

Figure 6A:
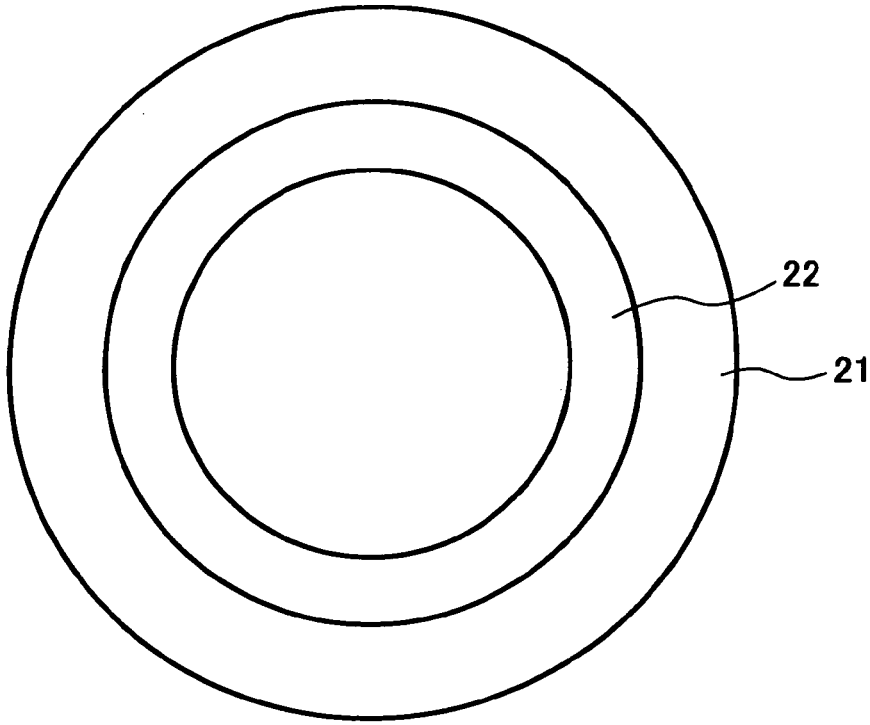
FIG. 6A is a plan view illustrating an electrode for measuring.

The surface resistivity and volume resistivity of the intermediate transfer belt were measured based on JIS-K6911 using a ring electrode 21 and a pillar electrode 22, as illustrated in FIG. 6A. Based on JIS-K6911, the surface resistivity and the volume resistivity were calculated by using the following formulae:

$$\rho v=\pi d^2/4t\times R_v$$

$$\rho s=\pi(D+d)/(D-d)\times R_s$$

In these formulae, ρv represents volume resistivity (MΩcm), ρs represents surface resistivity (MΩ), d represents the outer diameter of the pillar electrode (cm), t represents the thickness of the target to be measured, Rv represents volume resistivity (MΩ), D represents the inner diameter of the ring electrode on the surface, Rs represents the surface resistivity (MΩ), and π represents the ratio of the circumference of a circle to the diameter of the circle.

Figure 6B:
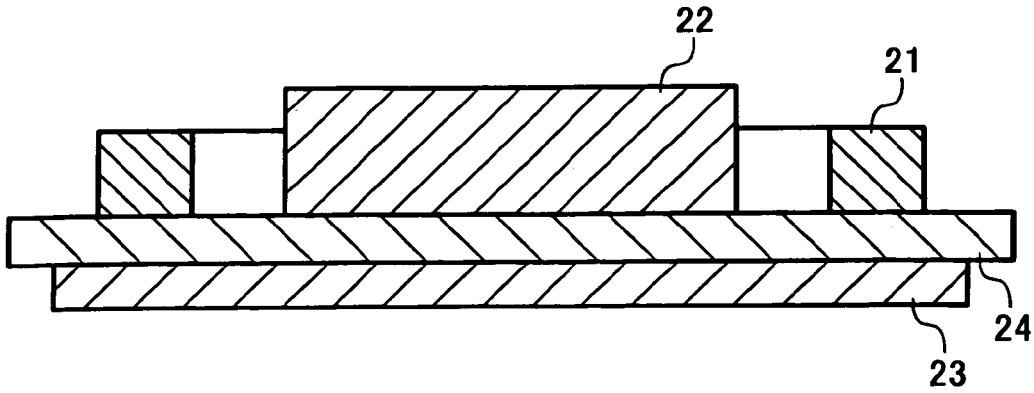
FIG. 6B is a longitudinal section illustrating a surrounding of an electrode portion.

As illustrated in FIG. 6B, the ring electrode 21 and the pillar 22 were concentrically located on the measuring side of the insulation board 24. The resistance between the ring electrode 21 and the pillar electrode 22 was defined as Rs. When measuring the resistance, an earth electrode 23 was provided on the side opposite to the side to be measured. The surface resistivity of the intermediate transfer belt has a surface resistivity ρs of $6.02\times10^{11}\Omega$ when the surface resistivity was measured by this measuring method. The resistance between the pillar electrode and its facing electrode was defined as Rv. The volume resistivity ρv of the intermediate transfer belt was $9.03\times10^{9}$ Ωcm when the surface resistivity was measured by this measuring method.

Imidization ratio of the intermediate transfer belt was determined based on the peak intensity ratio measured by a transmission method using FT/IR (ATR) SpectrumGX device (PERKIN ELMER).

(Imidization ratio)=(A1780/A1500)/(Aimd 1780/Aimd 1500)×100 In the relationship mentioned above, A1780 represents the absorption intensity based on 1780 $cm^{-1}$ imide linkage peak of a sample before heat treatment, A1500 represents the absorption intensity based on 1500 $cm^{-1}$ benzene ring peak of a sample before heat treatment, Aimd 1780 represents the absorption intensity based on 720 $cm^{-1}$ imide linkage peak of a heat treatment film before drawing, and Aimd 1500 represents the absorption intensity based on 1500 $cm^{-1}$ benzene ring peak of a heat treatment film before drawing.

The imidization ratio measured by this method was 90%.

Figure 7:
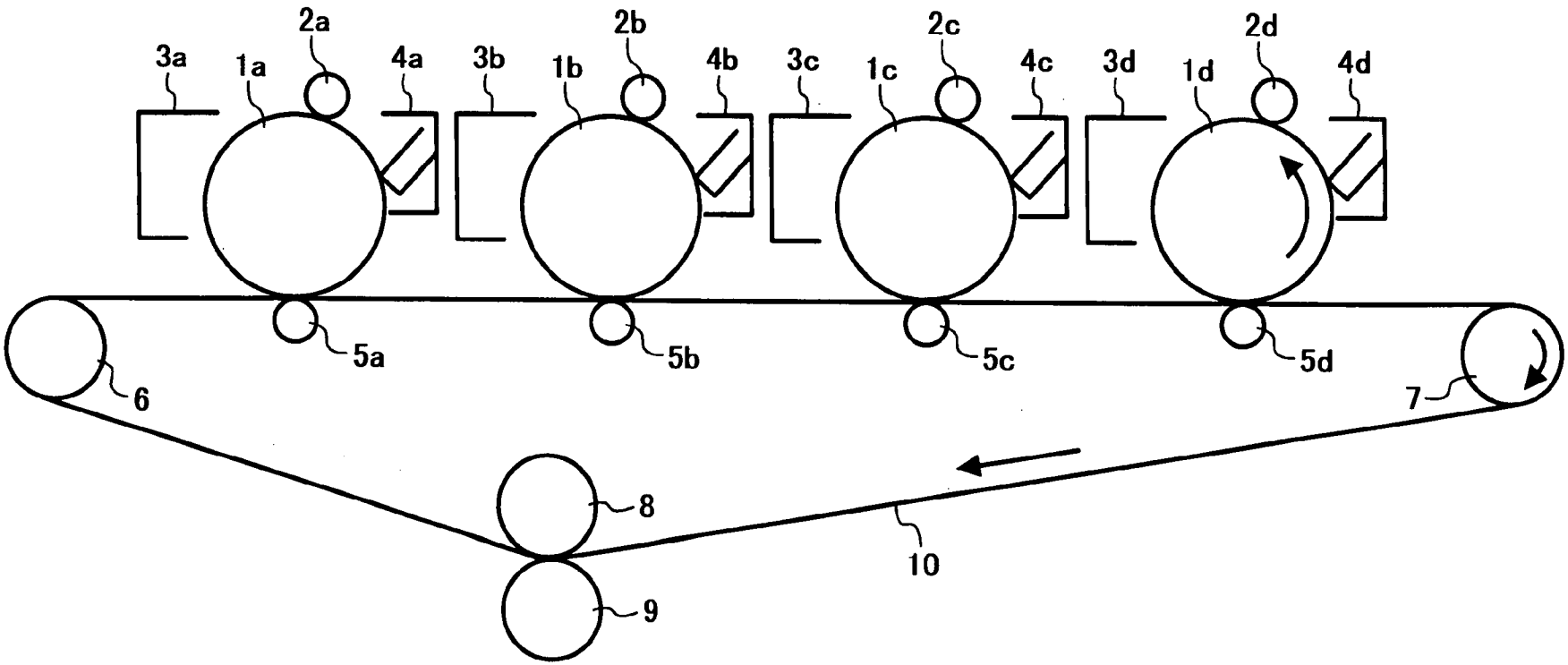
FIG. 7 is a schematic lateral view illustrating an example of the image forming apparatus using the endless intermediate transfer belt of the present invention for use in electrophotography.

An image forming apparatus illustrated in FIG. 7 include the following: photoreceptor drums (1*a*, 1*b*, 1*c* and 1*d*), which are charged substances functioning as image bearing members; chargers (2*a*, 2*b*, 2*c* and 2*d*) to charge the photoreceptor drums; an irradiation portion (not shown) to irradiate the charged photoreceptor drums to form images thereon; developing devices (3*a*, 3*b*, 3*c* and 3*d*) to develop the irradiated images on the irradiated photoreceptor drums with a toner; an intermediate transfer belt 10 to receive the transfer of the toner images developed by the developing devices; photoreceptor cleaners (4*a*, 4*b*, 4*c* and 4*d*) to clean the photoreceptor drums; primary transfer rollers (5*a*, 5*b*, 5*c*and 5*d*); an intermediate transfer belt driving roller 6; an intermediate transfer belt pressing roller 7; an intermediate transfer belt opposing roller 8; a transfer roller 9; a transfer belt cleaner (not shown) to clean the intermediate transfer belt 10; and a fixing device (not shown) to fix the toner images transferred onto a transfer material from the intermediate transfer belt 10.

The developing devices mentioned above have a developing device 3*a*for black color, a developing device 3*b*for cyan color, a developing device 3*c*for magenta color and a developing device 3*d*for yellow color.

When the line images illustrated in FIG. 8 were photocopied by the image forming apparatus mentioned above, since there was no speed difference among the photoreceptor drums, the registration shift of each color image did not occur and clear and good images were obtained.

Example 2

The intermediate transfer belt of Example 2 was obtained in the same manner as in Example 1 except that, after volatilizing the solution from the polyamide acid mixture solution layer 31*a*, the polyamide acid belt (i.e., partially imidized belt) 31*b*was removed from the cylinder mold 33 and set on a drawing device illustrated in FIG. 2 and the temperature was set to 80° C. Imidization ratio was not greater than 90%.

The obtained intermediate transfer belt showed good self-support property. The elasticity modulus of the intermediate transfer belt was measured. The elasticity modulus in the circumferential direction was 7,100 MPa and the elasticity modulus in the axial direction was 7,500 MPa. The intermediate transfer belt had a surface resistivity ρs of $5.12\times10^{11}\Omega$ and a volume resistivity ρv of $8.12\times10^{9}$ Ωcm.

When the line images illustrated in FIG. 8 were photocopied using the image forming apparatus, since there was no speed difference among the photoreceptor drums, the registration shift of each color toner image did not occur and good, clear images were obtained.

Example 3

The intermediate transfer belt of Example 3 was obtained in the same manner as in Example 1 except that, after sufficiently volatilizing the solution of the polyamide acid mixture solution layer 31*a*, the polyamide acid belt (i.e., partially imidized belt) 31*b*was removed from the cylinder mold 33 and set on a drawing device illustrated in FIG. 2 and the temperature was set to 60° C. The imidization ratio was not greater than 90%.

Although it took a relatively long time in comparison with Example 2, the obtained intermediate transfer belt showed good self-support characteristics. The elasticity modulus of the intermediate transfer belt was measured. The elasticity modulus in the circumferential direction was 7,000 MPa and the elasticity modulus in the axial direction was 7,200 MPa. The volume resistivity ratio of the belt was measured. The intermediate transfer belt had a surface resistivity ρs of $7.12\times10^{11}\Omega$ and a volume resistivity ρv of $8.92\times10^{9}$ Ωcm.

When the line images illustrated in FIG. 8 were photocopied using the image forming apparatus, since there was no speed difference among the photoreceptor drums, the registration shift of each color image did not occur and clear and good images were obtained.

Example 4

The intermediate transfer belt of Example 4 was obtained in the same manner as in Example 1 except that the drawing in the circumferential direction was not performed. The elasticity modulus of the intermediate transfer belt was measured. The elasticity modulus in the circumferential direction was 7,200 MPa and the elasticity modulus in the axial direction was 7,400 MPa. The intermediate transfer belt had a surface resistivity ρs of $6.12\times10^{11}\Omega$ and a volume resistivity ρv of $9.12\times10^{9}$ Ωcm.

When the line images illustrated in FIG. 8 were photocopied using the image forming apparatus, since there was no speed difference among the photoreceptor drums, the registration shift of each color image did not occur and good, clear images were obtained.

The intermediate transfer belt of Example 5 was obtained in the same manner as in Example 1 except that the drawing in the axial direction was not performed. The elasticity modulus of the intermediate transfer belt was measured. The elasticity modulus in the circumferential direction was 7,500 MPa and the elasticity modulus in the axial direction was 7,300 MPa. The intermediate transfer belt had a surface resistivity ρs of $6.17\times10^{11}\Omega$ and a volume resistivity ρv of $9.17\times10^{9}$ Ωcm.

When the line images illustrated in FIG. 8 were photocopied using the image forming apparatus, since there was no speed difference among the photoreceptor drums, the registration shift of each color image did not occur and good, clear images were obtained.

Comparative Example 1

The sample belt of Comparative Example 1 was obtained in the same manner as in Example 1 except that, after pouring the polyimide acid solution, the film was imidized without drawing the film after drying the film up to 100° C. The elasticity modulus of the intermediate transfer belt was measured. The elasticity modulus in the circumferential direction was 3,500 MPa and the elasticity modulus in the axial direction was 3,200 MPa.

When the line images illustrated in FIG. 8 were photocopied using the image forming apparatus, primary transfer of each color toner image was performed well, but each color toner image did not overlap well with the other toner color images. That is, each color toner image was not properly transferred. Therefore, color shifts occurred in the color image on a transfer paper, resulting in failure to obtain good color images.

Comparative Example 2

The sample belt of Comparative Example 2 was obtained in the same manner as in Example 1 except that, after pouring the polyimide acid solution, the drying temperature was up not to 100° C. but to 180° C. The elasticity modulus of the intermediate transfer belt was measured. The elasticity modulus in the circumferential direction was 2,550 MPa and the elasticity modulus in the axial direction was 2,210 MPa.

When the line images illustrated in FIG. 8 were photocopied using the image forming apparatus, primary transfer of each color toner image was performed well, but each color toner image did not overlap well with the other color toner images. That is, each color toner image was not properly transferred. Therefore, color shifts occurred in the color image on a transfer paper, resulting in failure to obtain good color images.

Comparative Example 3

After pouring the polyamide acid mixture solution, drying was performed not up to 100° C. but at 23° C. The result was that a film was not formed. That is, the strength necessary to be drawn was not obtained, i.e., drawing was not performed.

According to the endless intermediate transfer belt obtained in Examples mentioned above, uniform belts in which carbon is well dispersed can be obtained by using a polyamic acid mixture as the base material. As a result, endless belts having an excellent elasticity modulus can be obtained.

In addition, by drying the polyamide acid belt in the temperature range of from 25°C. to 220° C. to imidize the belt, the strength of the belt is strong enough to have good self-supporting characteristics and an imidized film having a uniform surface can be obtained.

Further, by drawing the polyamide acid belt in the temperature range of from 25° C. to 220° C., the film can be optimally drawn without solidifying during drawing.

Furthermore, by limiting the drawing magnification power of the polyamide acid belt in the circumferential direction to from 1.01 to 1.10, a belt having an excellent elasticity modulus can be obtained. When forming an image by using this belt, registration shift of each color toner image does not occur and thus good, clear images can be obtained.

Also, by limiting the drawing magnification power for the polyamide acid belt in the axial direction to from 1.01 to 1.10, a belt having an excellent elasticity modulus was obtained. When forming an image by using this belt, registration shift of each color toner image did not occur and thus good, clear images were obtained.

In addition, as for Examples mentioned above, since the belt has an elasticity modulus of from 7,000 to 15,000 MPa, an intermediate transfer belt having a high elasticity modulus and an excellent mechanical strength can be obtained. Good images without a registration shift in each toner image can be obtained by such an intermediate transfer belt.

Further, since such a belt has a surface resistivity ρs of from $1.0\times10^{10}$ to $1.0\times10^{13}\Omega$, a good electrophotographic process, i.e., a good transfer process irrespective of the difference in Q /M of a toner, can be performed and thus a good image can be obtained.

Furthermore, since such a belt has a volume resistivity ρv of from $1.0\times10^{5}$ to $1.0\times10^{11}\Omega$, a good electrophotographic process, i.e., a good transfer process irrespective of the difference in Q/M of a toner, can be performed and thus a good image can be obtained.

This document claims priority and contains subject matter related to Japanese Patent Applications No. 2004-130354 and 2005-117179, filed on Apr. 26, 2004, and Apr. 14, 2005, respectively, each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An intermediate transfer belt, comprising:

a drawn component not greater than 98% of which is imidized, wherein the intermediate transfer belt is used in electrophotographic image forming process in which plurality of toner images formed of a single color on plurality of image bearing members are overlappingly transferred to the intermediate transfer belt to form a multi-colored image thereon, which is transferred to a transfer material, and the intermediate transfer belt has an elasticity modulus of from 7,000 to 15,000 MPa.

2. An intermediate transfer belt prepared by a process, comprising:

transferring a mixture of a solution of a thermosetting resin and a particulate electroconductive material into a centrifugal mold;

rotating the centrifugal mold to form a film attached to an inner periphery thereof;

thermally imidizing the film to have an imidization ratio not greater than 98%; and drawing the film to entirely harden the film and to form the intermediate transfer belt;

wherein the intermediate transfer belt is used in an electrophotographic image forming process in which a toner image of each color formed on plurality of image bearing members is overlappingly transferred to the intermediate transfer belt to form a multi-colored image thereon, which is transferred to a transfer material, and the intermediate transfer belt has an elasticity modulus of from 7,000 to 15,000 MPa.

3. The intermediate transfer belt according to claim 2, wherein the drawing is performed in a circumferential direction of the film.

4. The intermediate transfer belt according to claim 3, wherein the drawing is performed in the circumferential direction to a magnification power of 1.01 to 1.10.

5. The intermediate transfer belt according to claim 4, wherein the film is drawn by a drawing base at a constant drawing speed while the film is rotated.

6. The intermediate transfer belt according to claim 2, wherein the drawing is performed in an axial direction of the intermediate transfer belt.

7. The intermediate transfer belt according to claim 6, wherein the drawing is performed in the axial direction to a magnification power of 1.01 to 1.20.

8. The intermediate transfer belt according to claim 2, wherein the drawing is performed in a circumferential direction and in an axial direction of the film.

9. The intermediate transfer belt according to claim 8, wherein the drawing is performed in the circumferential direction and in the axial direction to a magnification power of 1.01 to 1.15.

10. The intermediate transfer belt according to claim 2, wherein, while the film is rotated, the film is drawn by a chucking portion of a drawing device in a direction different from the rotation direction of the film to a drawing magnification power of from 1.01 to 1.20.

11. The intermediate transfer belt according to claim 2, wherein the mixture is a polyamic acid solution.

12. The intermediate transfer belt according to claim 2, wherein the thermal imidizing is performed at a temperature range of from 25 to 220° C.

13. The intermediate transfer belt according to claim 2, wherein the drawing is performed in a temperature range of from 25 to 220° C.

14. The intermediate transfer belt according to claim 2, further having a surface resistivity ρs of from $1.0\times10^{10}$ to $1.0\times10^{13}\Omega$.

15. The intermediate transfer belt according to claim 2, further having a volume resistivity ρv of from $1.0\times10^{5}$ to $1.0\times10^{11}\ \Omega$cm.

16. An image forming apparatus, comprising:

an image bearing member configured to bear a latent electrostatic image;

a charging device configured to charge a surface of the image bearing member;

a developing device configured to develop the latent electrostatic image with a toner;

a cleaning device configured to remove residual toner on the image bearing member; an intermediate transfer belt configured to transfer the toner image on the image bearing member to form an image thereon and to transfer the toner image onto a recording material, the intermediate transfer belt, comprising a drawn component not greater then 98% of which is imidized; and a fixing device configured to fix the toner image on the recording material.

17. An image forming method, comprising:

irradiating an image bearing member with a laser beam to form a latent electrostatic image on the image bearing member;

developing the latent electrostatic image with a toner;

removing residual toner on the image bearing member;

transferring the toner image to an intermediate transfer belt, said belt prepared by a process comprising:

transferring a mixture of a solution of a thermosetting resin and a particulate electroconductive material into a centrifugal mold;

rotating the centrifugal mold to form a film attached to an inner periphery thereof;

thermally imidizing the film to have an imidization ratio not greater than 98%; and drawing the film to entirely harden the film and to form the intermediate transfer belt;

transferring the toner image on the intermediate transfer belt to a recording material; and fixing the toner image on the recording material upon application of heat and pressure, wherein the intermediate transfer belt has an elasticity modulus of from 7,000 to 15,000 MPa.

* * * * *